US007990248B2

(12) United States Patent
Feist et al.

(10) Patent No.: US 7,990,248 B2
(45) Date of Patent: Aug. 2, 2011

(54) INSULATION ALEMENT AND TOROIDAL CORE THROTTLE

(75) Inventors: Günter Feist, Gingen/Fils (DE); Karl Niklas, Königsbronn-Itzelberg (DE); Jürgen Stabenow, Heidenheim (DE)

(73) Assignee: EPCOS AG, Munich (DE)

( * ) Notice: Subject to any disclaimer, the term of this patent is extended or adjusted under 35 U.S.C. 154(b) by 142 days.

(21) Appl. No.: 11/816,041

(22) PCT Filed: Feb. 10, 2006

(86) PCT No.: PCT/DE2006/000231

§ 371 (c)(1),
(2), (4) Date: Oct. 12, 2007

(87) PCT Pub. No.: WO2006/084450

PCT Pub. Date: Aug. 17, 2006

(65) Prior Publication Data

US 2008/0164968 A1 Jul. 10, 2008

(30) Foreign Application Priority Data

Feb. 11, 2005 (DE) ..... 10 2005 006 344

(51) Int. Cl.
*H01F 27/28* (2006.01)
*H01F 27/06* (2006.01)
*H01F 27/30* (2006.01)

(52) U.S. Cl. ..... 336/229; 336/65; 336/66; 336/206; 336/222

(58) Field of Classification Search ..... 336/229
See application file for complete search history.

(56) References Cited

U.S. PATENT DOCUMENTS

| | | | | |
|---|---|---|---|---|
| 2,947,960 | A | 8/1960 | Fredrickson | |
| 3,209,294 | A | 9/1965 | Cornell | |
| 3,321,725 | A | 5/1967 | Canney | |
| 4,769,900 | A | 9/1988 | Morinaga et al. | |
| 5,169,099 | A | 12/1992 | Yang | |
| 5,393,934 | A | 2/1995 | Mori et al. | |
| 5,539,307 | A | 7/1996 | Bischof et al. | |
| 6,365,836 | B1 * | 4/2002 | Blouin et al. | 174/113 C |
| 7,280,027 | B2 | 10/2007 | Feth et al. | |
| 7,400,224 | B2 | 7/2008 | Feist | |
| 7,479,865 | B2 | 1/2009 | Feist et al. | |
| 7,498,916 | B2 | 3/2009 | Feist et al. | |
| 2006/0055496 | A1 * | 3/2006 | Na et al. | 336/229 |

(Continued)

FOREIGN PATENT DOCUMENTS

| | | |
|---|---|---|
| CH | 227022 | 8/1943 |

(Continued)

OTHER PUBLICATIONS

English translation of International Preliminary Report for PCT/DE2006/000231.

(Continued)

*Primary Examiner* — Anh T Mai
*Assistant Examiner* — Mangtin Lian
(74) *Attorney, Agent, or Firm* — Fish & Richardson P.C.

(57) ABSTRACT

A toroidal core choke includes a toroidal core and an insulating part. The insulating part includes a separating device for separating winding spaces on the toroidal core. The separating device includes a divider and a spacer on an end of the divider. A width of the divider is less than a width of the spacer.

21 Claims, 4 Drawing Sheets

U.S. PATENT DOCUMENTS

| | | | | |
|---|---|---|---|---|
| 2006/0192649 | A1 * | 8/2006 | Feth et al. | 336/229 |
| 2007/0202727 | A1 | 8/2007 | Feist et al. | |
| 2007/0241855 | A1 | 10/2007 | Feist | |
| 2007/0285911 | A1 | 12/2007 | Feist et al. | |
| 2008/0117009 | A1 | 5/2008 | Feist et al. | |
| 2008/0129436 | A1 | 6/2008 | Feist et al. | |
| 2008/0164968 | A1 | 7/2008 | Feist et al. | |
| 2009/0115559 | A1 | 5/2009 | Feist et al. | |
| 2009/0152003 | A1 | 6/2009 | Feist et al. | |

FOREIGN PATENT DOCUMENTS

| | | | |
|---|---|---|---|
| CH | 290733 | | 8/1953 |
| DE | 1253353 | | 11/1967 |
| DE | 1563195 | | 11/1969 |
| DE | 2850657 | | 4/1982 |
| DE | 3047603 | | 7/1982 |
| DE | 33 18 557 | | 11/1984 |
| DE | 8620742 | | 2/1988 |
| DE | 19604480 | | 8/1997 |
| DE | 199 32 475 | | 2/2001 |
| DE | 199 32 475 | A1 * | 2/2001 |
| DE | 19932475 | A1 * | 2/2001 |
| DE | 102 23 995 | | 11/2003 |
| DE | 103 08 010 | | 9/2004 |
| EP | 0258592 | | 3/1988 |
| GB | 2008858 | | 6/1979 |
| JP | 54-156754 | | 10/1979 |
| JP | 60-179013 | | 11/1985 |
| JP | 60-1179013 | | 11/1985 |
| JP | 03-000019 | | 1/1991 |
| JP | 06-302437 | | 10/1994 |
| JP | 08-285897 | | 11/1996 |
| JP | 09-045539 | | 2/1997 |
| JP | 09-237717 | | 9/1997 |
| JP | 09237717 | A * | 9/1997 |
| JP | 10-106861 | | 4/1998 |
| JP | 2001-274030 | | 10/2001 |
| WO | WO2004/077459 | A1 * | 2/2004 |
| WO | WO2004/055840 | | 7/2004 |
| WO | WO2004/077459 | | 9/2004 |
| WO | WO 2004/077459 | A1 * | 9/2004 |
| WO | WO2006/015589 | | 2/2006 |
| WO | WO2006/039876 | | 4/2006 |
| WO | WO2006/084450 | | 8/2006 |

OTHER PUBLICATIONS

Written Opinion for PCT/DE2006/000231.
Search Report for PCT/DE2006/000231.
English Translation of International Preliminary Report on Patentability in Application No. PCT/DE2005/001422, dated Feb. 13, 2007 (includes Eng. Transl. of Written Opinion).
International Search Report in Application No. PCT/DE2005/001422, dated Nov. 21, 2005.
Databook "Ferrite and Zubehor", EPCOS AG, Feb. 2002, pp. 34-41.
International Search Report and Written Opinion in Application No. PCT/DE2004/000171, dated Jun. 9, 2004.
International Preliminary Report on Patentability in Application No. PCT/DE2004/000171, dated Sep. 23, 2005.
Machine Translation of Japanese Application No. 10-106861.
Machine Translation of Japanese Application No. 2001-274030.
Machine Translation of German Application No. DE8620742.
Action and Response History in U.S. Appl. No. 11/573,616, as retrieved from PAIR on Sep. 8, 2009.
Action and Response History in U.S. Appl. No. 10/545,362, as retrieved from PAIR on Sep. 8, 2009.
Action and Response History in U.S. Appl. No. 11/573,616, as retrieved from PAIR on Mar. 18, 2010.
Action and Response History in U.S. Appl. No. 11/573,616, as retrieved from PAIR on Nov. 4, 2010.
English Translation of Notification of Reasons for Refusal (dated Nov. 11, 2010) in Japanese Application No. 2007-554418.
English Translation of Notification of Reasons for Refusal (dated Sep. 28, 2010) in Japanese Application No. 2007-525164.
Prosecution History in U.S. Appl. No. 11/573,616, as retrieved on Feb. 10, 2011.

* cited by examiner

INSULATION ALEMENT AND TOROIDAL CORE THROTTLE

TECHNICAL FIELD

This patent application relates to an insulating part for separating a toroidal core choke with several windings. In addition, this patent application relates to a toroidal core choke with an insulating part.

BACKGROUND

DE10308010A1 describes an insulating part that can be inserted into a toroidal core hole for a toroidal core choke.

SUMMARY

Described herein is an insulating part for a toroidal core choke, which can also be used in small toroidal cores.

An insulating part that can be installed in a core hole of a toroidal core is described. The insulating part has a separating device for forming separate winding spaces and for connecting spacers. The separating device comprises at least one divider, which runs in a radial direction, which is connected at its first end to a first spacer, and whose width W is smaller than the width b of the spacer.

When the insulating part installed, the width b of the spacer may be large relative to a width W of the divider.

In one embodiment, the width W is the thickness of a divider or its cross-sectional width. The divider may be solid and may have no hollow spaces.

At least one of the spacers may be an elastically deformable part. The elastically deformable part may have a width that is large relative to the width W of the divider in a deformed state transverse to a radial direction, and to a longitudinal direction, of the insulating part. The elastically deformable part may deform in response a force acting in the radial direction, in which case its width measured transverse to the radial direction may increase. Because the deformable part is usually supported against a support structure—e.g., the internal wall of a toroidal core—under the effect of the force, the dimensional stability of the deformable part relative to its width transverse to the radial direction can be achieved. As a result, the part can be used transverse to the radial direction as a spacer, e.g., for spatial separation of two windings of a toroidal core choke. The width of the deformable part determines the insulation spacing of a toroidal core choke surrounding the insulating part. The width of the deformable part may be, e.g., at least 2×W.

In one embodiment, the insulating part includes a radial divider with a width W. The insulating part has, on its first end, an elastically deformable spreading part. When spread, the spreading part has a spread width b—i.e., an open spacing between spread endpoints—which is at least two times the width W. In one embodiment, the width $b \geqq 3W$.

The width W of the divider may be selected so that the divider is definitely relatively narrow, but is nevertheless rigid.

The wall thickness w of components of the spreading part may be selected accordingly, so that the components are at least deformable, e.g., flexible and thus spreadable.

When spread, the length h of the spreading part measured in the radial direction is small relative to its spread width b. In one embodiment, $h<0.4b$.

The radial length h of the spreading part when spread may be small relative to a length a of the divider measured in the radial direction. For example, $h<0.5a$, or $h<0.4a$.

The radial length h of the spreading part when spread may be small relative to a cross-sectional size d of the insulating part—defined by the diameter of the core hole—in one embodiment $h<0.2d$.

The spreading part is pressed against the inner wall of the toroidal core at expanding endpoints when installed in a toroidal core. In this way, the relative slippage of windings to be separated from each other past the expanding endpoints is prevented. Thus, a preset insulation spacing between the spread endpoints, that is essentially transverse to the radial direction or also in the peripheral direction of the toroidal core, is guaranteed. The spreading part may be used as a spacer between windings to be separated from each other. The insulation spacing is fixed by the open spacing L between spread endpoints and is essentially equal to this spacing.

Because spacing elements for guaranteeing an insulation spacing are formed on the end of the divider in a space-saving way, the divider can be narrow. Thus, relatively large winding spaces separated from each other can be guaranteed despite maintaining a large insulation spacing.

Because the insulating part is spring-elastic in the radial direction due to the spreading part, a simple assembly is possible when installing in a toroidal core. Although toroidal cores can have relatively large deviations from each other with respect to their inner diameter, it is possible to compensate for these tolerances with the insulating part described herein.

The divider is branched in cross section, such as with a Y-shape, for forming a spreading part with a V-shaped cross section at its first end in two spring elements. The spreading part has two elastically deformable, for example, leaf-shaped spring elements (spiral springs) that are different in cross section than one running in the radial direction. The cross-sectional length L of a spring element measured transverse to the divider main surface is large relative to the width W of the divider, e.g., $L>1.5W$ or $L>2W$.

The spread angle β can be, for example, between 90° and 180°, and between 120° and 170° in one embodiment. With a large spread angle $\geqq 150°$, it is possible to achieve an especially large spread width and, therefore, an especially large insulation spacing, as well as the largest possible winding spaces.

The cross-sectional length L of a spring element may be large relative to the radial length h of the spreading part, e.g., $L>2h$. The cross-sectional length L of a spring element can be more than 0.5a, where a is the radial length of the divider.

The width W of the divider may be a function of the elastic properties of the material of the divider and as a function of the diameter of the core hole, so that the divider is definitely thin, but remains dimensionally stable when inserted into the core hole. The width W of the divider may be between 1.5 and 5 mm, e.g., 1 to 1.5 mm for a core hole diameter below 15 mm, 1.5 to 2 mm for a core hole diameter between 15 and 25 mm, 1.5 to 2.5 mm for a core hole diameter between 20 and 50 mm, and 2.5 to 5 mm for a core hole diameter between 50 and 100 mm. The wall thickness w of a spring element—apart from its regions with beveled edges—may be at least 50% of the width W of the divider.

The cross-sectional length L of each spring element may be at least 3.5 mm. The cross-sectional length L of a spring element can be, in one variant, at least 4.5 mm.

The spread width b of the spreading part can be greater than 8 mm and, e.g., greater than 9 mm.

Advantageously, at the second end of the divider there can be a device acts as an abutment. The abutment can be formed by another spreading part, which is also used as a spacer for guaranteeing the preset insulation spacing, and which may be constructed like the first spreading part. Such an insulating part is suitable for a toroidal core choke with two windings.

In another embodiment, the abutment can be formed, e.g., by a non-deformable part, which represents a widened part of the divider and which is used as a spacer for guaranteeing the preset insulation spacing. This insulating part can be used in particular in a toroidal core choke with two windings.

In one embodiment, the main surfaces of the widened part run at an angle between 60° and 120°, e.g., 80° relative to each other. The widened part of the divider can have in cross section the basic shape of a sector of a circle. The edge of the widened part of the divider facing away from the divider can have in cross section the shape of a circular arc, whose length is, e.g., at least 10 mm. Furthermore, the widened part can have beveled edges and/or at least one recess for receiving a holding element.

In another embodiment, the abutment can be formed such that the divider is connected on its end facing away from the spreading part, which forms a star point, to other dividers that may also be star shaped. The other dividers may also have a spreading part at their end facing away from the star point. A number $n \geqq 2$ of dividers is used for insulated separation of the core hole into n winding spaces. It is useful to form all of the spreading parts of the insulating part equally. In one embodiment of the insulating part, the dividers are offset essentially by an angle of 360°/n relative to each other. In this way it is possible to divide the core hole into winding spaces of equal size.

The insulating part can have several radial dividers with two elastically deformable spring elements extending different from a radial direction. It is useful to form the spring elements connected to the same divider symmetric relative to each other. It is advantageous to form various dividers with the spring elements equally.

The insulating part may be formed in one piece. The insulating part may be an injection-molded part, which may contain a thermoplastic, e.g., polycarbonate. Polycarbonate has the advantage that it provides, on one hand, very good electrical insulation and, on the other hand, very good behavior in fire, namely very low combustibility in accordance with the UL 94 V-0 standard. As the polycarbonate, the materials Lexan or also Makrolon can be used, for example. Other electrically insulating materials can also be used, which are dimensionally stable at a thickness given for the divider and are deformable at a smaller thickness provided for spring elements.

The insulating part is distinguished by a high mechanical stability, which allows the insulating part to be pushed as a one-piece element into the core hole of the toroidal core before the toroidal core is wrapped. Each section of the toroidal core between two dividers is wrapped with a winding. Thus, a toroidal core choke is made with potential separation.

Due to the spring elements interacting with the rigid dividers, the insulating part can be attached mechanically very rigidly in the core hole of a toroidal core, which has the advantage that the dividers of the insulating part cannot be pressed away during the wrapping.

With the insulating part, it is possible to achieve a large insulating path, i.e., air or creep path, between two windings to be separated, without limiting the winding space defined by the core hole.

In an advantageous embodiment, the insulating part has an n-fold axis of symmetry. That is, the insulating part is mapped onto itself when rotating about the axis of symmetry about an angle of 360°/n. Such symmetry has the advantage that the production can be simplified considerably.

Below, embodiments are explained in more detail with reference to associated figures. The figures show various embodiments in schematic and not-to-scale views. Parts that are identical or that have identical functions are designated with the same reference symbols.

DETAILED DESCRIPTION

In FIGS. 1, 2A to 2E, and 6, various views of an insulating part according to a first construction are presented.

Figure 1:
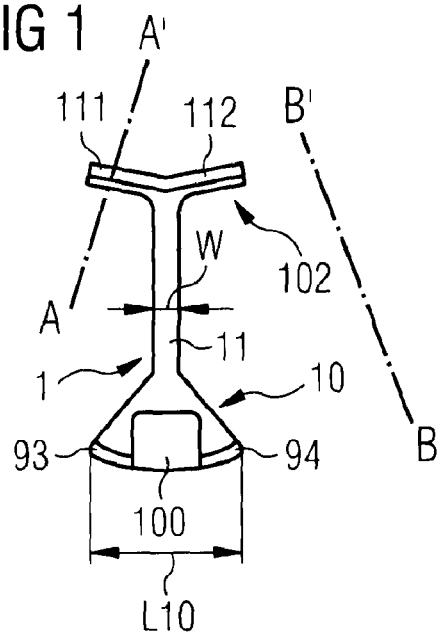
FIG. 1, a top view onto an insulating part for separating two windings.

FIG. 1 shows a top view onto an end of the insulating part, i.e., onto a side of the insulating part running transverse to the main surface of its divider 11.

The radial divider 11 is branched at its upper (first) end for forming, in this example, leaf-shaped spring elements 111, 112. The spring elements 111, 112 arranged on the outer end of the divider each extend differently from the radial direction.

The spring elements 111, 112 together form a first expanding part 102, which is suitable as a spacer for maintaining an insulation spacing. The spring elements 111, 112 form an angle of, e.g., 120° to 170° relative to each other in the ground state—i.e., before insertion into the core hole of a toroidal core—and are spread farther when inserted into the core hole (FIG. 7), where they press against the inner wall of the toroidal core 2.

By exerting a pressure in the radial direction, the spring elements of the insulating part can be deformed. The spring elements 111, 112 are distinguished by their flexibility, which means that they can be bent by pressing the divider 11, which is rigid compared with the spring elements, to the side in the radial direction. As a result, the insulating part can be adapted to various core-hole diameters.

The divider 11 has, at its lower (second) end, an spreading part 10. Spreading part 10, in the cross section transverse to the main surface of the divider, has the basic shape of a circular segment. The spreading part 10 forms a second spacer for maintaining an insulation spacing.

Figure 7:
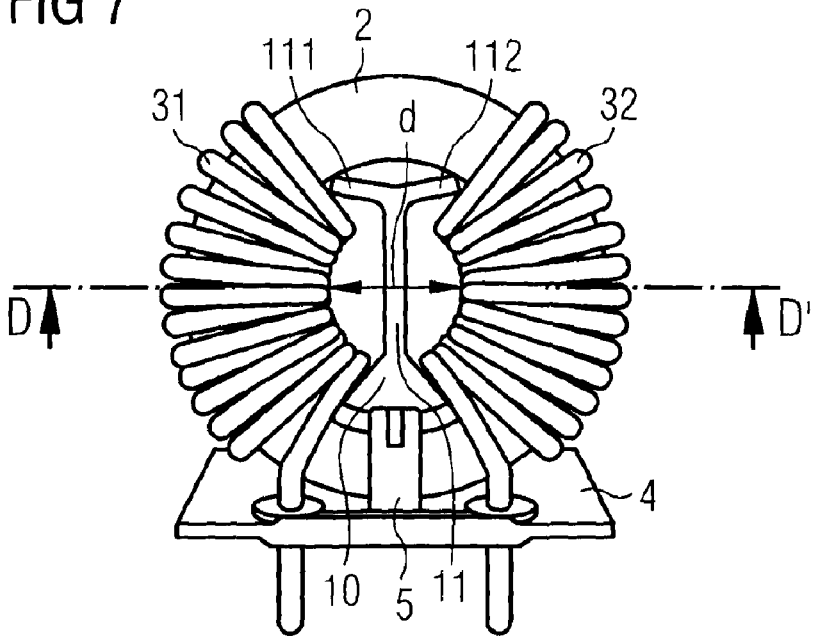
FIG. 7, a perspective view of a toroidal core choke with the insulating part according to FIG. 1.

The spreading part 10 has two recesses 100, which are each suitable for receiving a holding element 5 (FIG. 7).

Figure 2A:
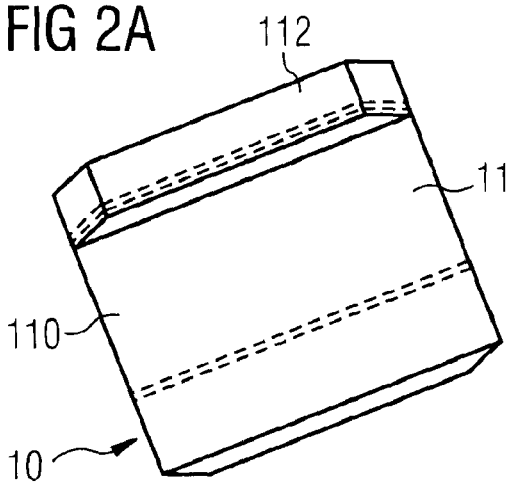
FIG. 2A, projection of the insulating part according to FIG. 1 onto projection plane BB'.
Figure 2B:
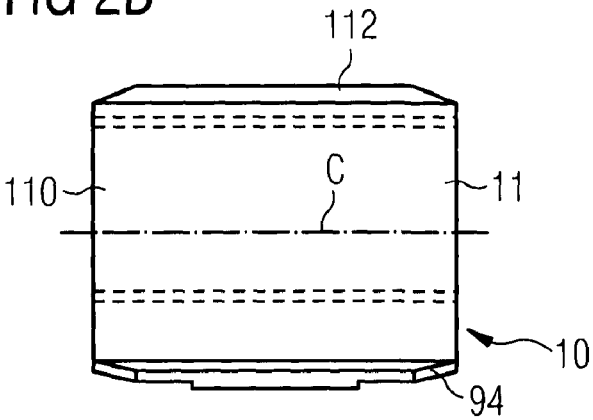
FIG. 2B, the top view onto the main surface of the insulating part according to FIG. 1.
Figure 2C:
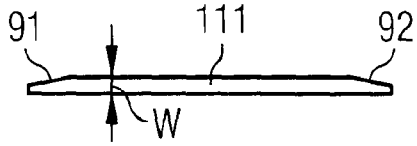
FIG. 2C, a spring element in cross section through cross-sectional plane AA'.
Figure 2D:
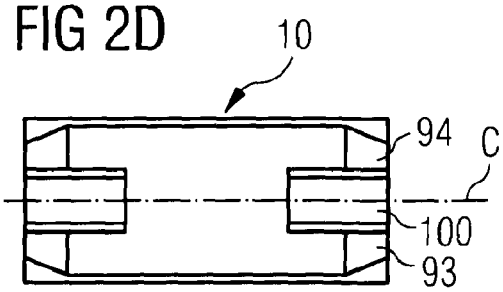
FIG. 2D, a view of the insulating part according to FIG. 1 from below.
Figure 2E:
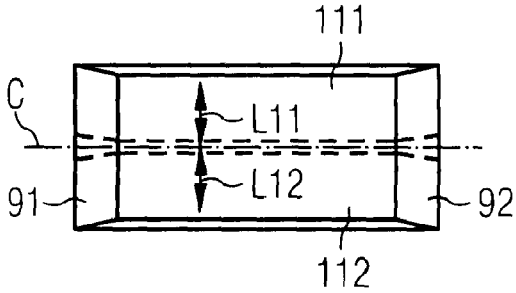
FIG. 2E, a view of the insulating part according to FIG. 1 from above.

The main surface 110 of the divider 11 extends parallel to a longitudinal axis C, which is shown in FIGS. 2B, 2D, and 2E, and which is directed along the axial direction of a toroidal core 2 shown in FIG. 7, into which the insulating part is inserted.

The insulating part has the advantage that it can be adapted to different core-hole diameters of toroidal cores based on the spreading part that is, e.g., deformable by a radial force. In addition, due to its relatively simple construction, the insulating part has can be produced easily and economically, for example, by injection molding.

In FIG. 2A, a view of the insulating part according to FIG. 1 is shown from the perspective of the plane BB' and in FIG. 2B a side view of the insulating part is shown.

In FIG. 2C, the spring element 111 is shown in a schematic cross section through the plane AA'.

The spring element 111 has beveled edges 91, 92 (FIGS. 2C and 2E). The maximum thickness w of the spring element 111 equals at least half the divider width W. This applies equally for the second spring element 112.

The widened part 10 can have beveled edges 93, 94 (FIGS. 2B and 2D). In principle, all of the edges and/or joint positions—e.g., the joint of the divider 11 and the part 10 or the joint of the divider 11 and of the spring element 111 or 112—can be rounded. The bevels 91 to 94 provided on the insulating part simplify the insertion of the insulating part into the core hole of a toroidal core.

On one hand, due to the spring elements 111, 112 and on the other hand due to the widened part 10, it is possible to distance the windings 31, 32 of the toroidal core choke from each other on both ends of the insulating part and thus to maintain the necessary minimum spacing (insulation spacing) between the windings. The insulation spacing can equal, e.g., 9.6 mm (air path), which corresponds to a creep path of 12.7 mm measured along the inner wall of the toroidal core.

Figure 3:
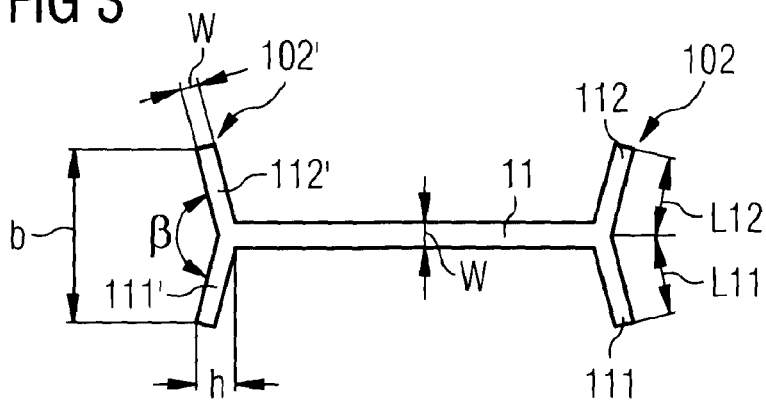
FIG. 3, a top view onto another insulating part for separating two windings.
Figure 4:
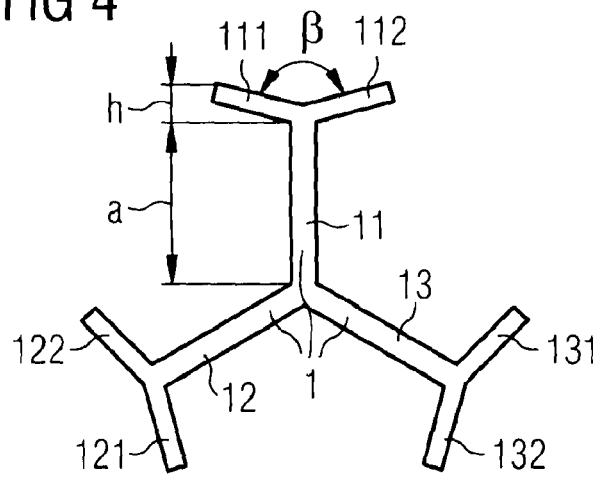
FIG. 4, a top view onto an insulating part for separating three windings.
Figure 5:
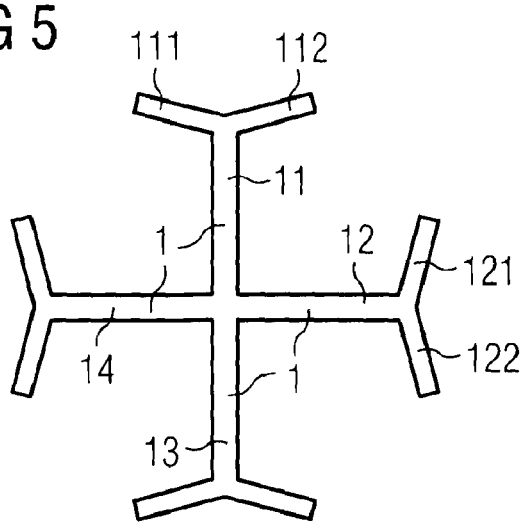
FIG. 5, a top view onto an insulating part for separating four windings.

In FIGS. 3 to 5, other possible constructions of an insulating part are shown with n dividers for potential separation between n windings. The insulating part has an n-fold axis of symmetry in the constructions shown here. The axis of symmetry runs transverse to the plane of the figures.

The dividers 11 and 12 (as well as divider 13 in FIGS. 4, 5 and divider 14 in FIG. 5) extend in the radial direction away from an imaginary center point of the insulating part. The n-fold axis of symmetry not shown in the figures runs through the imaginary center point.

In FIG. 3, an insulating part for separating two windings (n=2) is shown. The separating part 11 has on each of its two ends a spreading part 102 and 102'. Both spreading parts are constructed identically. The spreading part 102 comprises two spring elements 111, 112 and the spreading part 102' comprises two spring elements 111', 112'.

The spring element 111 has a length L11=L and the spring element may have the same spring length L12. The spread width b equals, for spring elements of equal length, $2L\times\sin(\beta/2)$, where L is the cross-sectional length of a spring element and β is a spread angle. The radial length h of the spreading part equals ca. $h=w+L\times\cos(\beta/2)$, where w is the thickness of the spring element.

The dividers 11, 12, 13, 14 for n>2 are connected to each other in the form of a star (see FIGS. 4 and 5).

Figure 6:
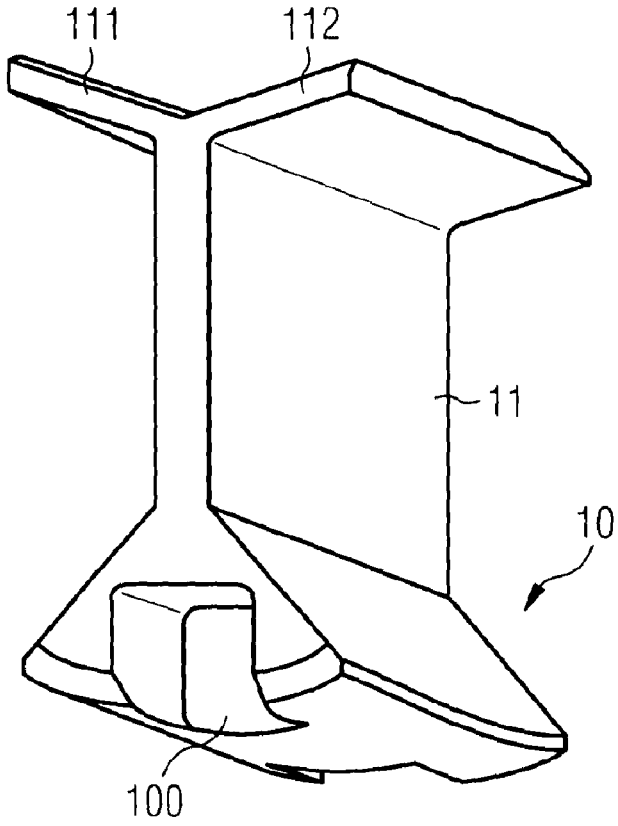
FIG. 6, the insulating part according to FIG. 1 in a perspective view.

A separating device 1 of the insulating part is formed in FIGS. 1, 3, and 6 by the divider 11. In FIG. 4, the separating device comprises three dividers 11, 12, 13 connected to each other in the shape of a star at an imaginary center point, and in FIG. 5, four dividers 11, 12, 13, 14 connected to each other.

In FIG. 4, an insulating part for separating three windings is shown (n=3). The angle between two dividers 11 and 12, 12 and 13, and also 13 and 11 here equals 360°/n=120°.

The divider 12 is branched on its end pointing outwards into spring elements 121, 122 and the divider 13 is branched into spring elements 131, 132. All of the dividers here have the same length a.

The radial length h of the spreading part formed by the spring elements 111, 112 is significantly smaller than the divider length a, because the spread angle β is selected to be large. For this reason, the spreading width b is also particularly large (see FIG. 3).

In FIG. 5, an insulating part for separating four windings is shown (n=4). The angle between two dividers 11 and 12, 12 and 13, 13 and 14, as well as 14 and 11 here equals 360°/n=90°.

An asymmetric insulating part with n dividers is also possible. An insulating part with n>4 dividers for forming n winding spaces separated from each other is also provided.

In FIG. 7, an example toroidal core choke with an insulating part according to the construction of FIG. 1 is shown. The toroidal core choke contains a toroidal core 2 with a core hole and two windings 31, 32. The core hole is divided by the insulating part 11, 111, 112, 10 into two winding spaces separated from each other for receiving a winding 31 and 32, respectively. Therefore, because the divider 11 is formed relatively narrow with, e.g., 1.5 to 3 mm, comparatively large winding spaces are made available.

The toroidal core choke is fixed on a mounting plate 4, in which openings for receiving winding ends for maintaining a given modular dimension of the toroidal core choke are provided. Two holding elements 5 for vertically fixing the toroidal core choke are provided on the mounting plate, with only one holding element 5 being visible in FIG. 7. The holding element 5 engages with a positive fit into the recess 100 of the insulating part. The holding element 5 holds the choke in FIG. 7 not at the insulating part, but instead at the toroidal core.

The length of the divider 11 measured in the radial direction may be at least 50% of the diameter of the core hole. In one embodiment, the length of the divider 11 equals at least 70% of the diameter of the core hole.

Figure 8:
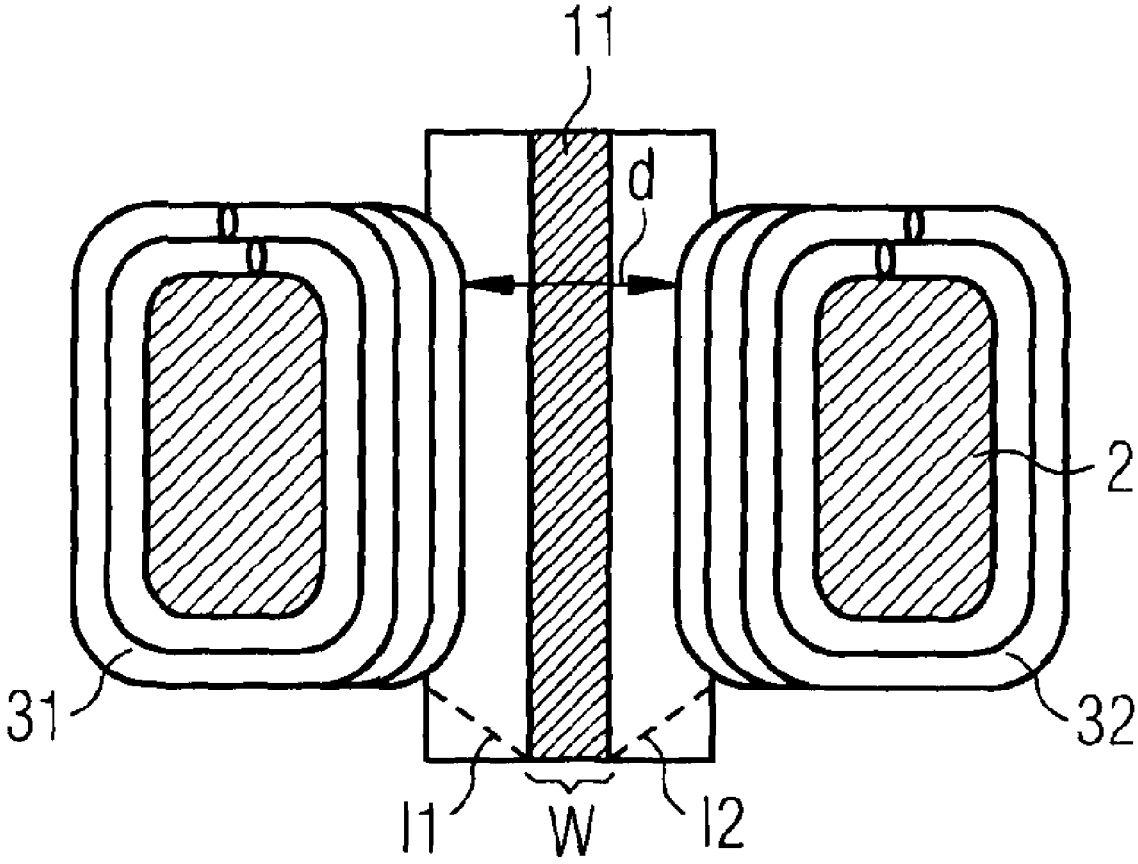
FIG. 8, cross section of the toroidal core choke according to FIG. 7.

The cross section of the toroidal core choke through the sectional plane DD' is shown in FIG. 8.

The height of the insulating part measured in the axial direction (longitudinal direction C, see FIGS. 2B, 2D, 2E) may be greater than the height of the toroidal core 2, so that the insulating part projects in this direction past the toroidal core, e.g., on both sides, see FIG. 8. This is advantageous for fixing the arrangement of the core and the insulating part during the component wrapping of the core. A projecting insulating part is also suitable due to the projection of the divider 11 for extending an air and creep path. whereby even for a tightly wrapped choke, a given air and creep path can also be guaranteed in the middle region of the choke.

In one advantageous embodiment, the divider 11 of the insulating part projects in the axial direction on both sides at least 3 mm past the toroidal core 2 or past the edge of the choke (upper or lower in FIG. 8). The projection may be at least 4.5 mm.

The actual air and creep path is a sum S=l1+W+l2 from the cross-sectional size of the divider W, a spacing l1 between the end of the divider 11—facing downwards in FIG. 8—and the end winding of the first winding 31 facing the divider, as well as a spacing l2 between the end of the divider 11 and the end winding of the second winding 32 facing the divider. The actual air and creep path may be at least as large as the given air and creep path.

Because the actual air and creep path is extended by a projecting insulating part, it is possible, on one hand, to maintain the larger air and creep path and, on the other hand, to effectively use the winding space, which is an advantage especially for toroidal cores with a small inner diameter.

The windings 31, 32 are spaced apart by the spacing d in a radial direction, which runs perpendicular to the divider in FIG. 7. In the embodiment shown in FIG. 8, this spacing is less than the actual air and creep path S=I1+W+I2. A sufficient air and creep path is thus guaranteed by divider 11 of the insulating part projecting past the toroidal core also in the middle region of the choke, where the spacing d may be selected to be smaller than the given air and creep path.

The claims are not limited to the elements shown in the figures. The construction of a spreading part is not limited to leaf-shaped spring elements. Instead, all possible suitable devices can be taken into account, in order to achieve a spring mounting of, e.g., rigid dividers in the radial direction. The dividers can have both a solid and also a hollow construction.

The invention claimed is:

1. An insulating part for installation into a hole of a toroidal core, the insulating part comprising:

a separating device for separating winding spaces on the toroidal core;

wherein the separating device comprises:

a divider; and a spacer on an end of the divider;

wherein the spacer comprises a spreading part, the spreading part being spreadable widthwise relative to the divider, wherein a width of the divider is less than a width of the spacer when the spreading part is spread, and wherein the divider comprises a first end and a second end that is away from the spreading part, the divider at least reaching a center point of the insulating part that is between the first end and the second end.

2. The insulating part of claim 1, wherein the width of the spacer is greater than or equal to twice the width of the divider when the spreading part is spread.

3. The insulating part of claim 2, wherein a radial length of the spreading part when spread is less than a spread width of the spreading part.

4. The insulating part of claim 3, wherein the radial length is less than or equal to 0.4 times the spread width.

5. The insulating part of claim 4, wherein the radial length of the spreading part when spread is less than a radial length of the divider; and wherein the radial length of the spreading part is less than or equal to 0.5 times the radial length of the divider.

6. The insulating part of claim 1, wherein the spreading part comprises elastically deformable spring elements that extend outwardly from the divider.

7. The insulating part of claim 1, wherein the separating device is Y-shaped.

8. The insulating part of claim 1, wherein the spacer comprises a first spacer, and the insulating part further comprises:

a second spacer on a second end of the divider, the second spacer comprising a spreader part that is usable as a support for the first spacer when inserted into the hole of the toroidal core.

9. The insulating part of claim 8, wherein main surfaces of the spreader part of the second spacer form an angle between 60° and 120° relative to each other.

10. The insulating part of claim 1, further comprising:

a second spacer on a second end of the divider.

11. The insulating part of claim 1, wherein the separating device comprises one or more additional dividers, each of the one or more additional dividers comprising a spacer at an end thereof, the one or more additional dividers being interconnected in a star configuration.

12. The insulating part of claim 11, wherein the divider and the one or more additional dividers are offset relative to each other by about an angle of 360°/n, where n is a total number of dividers.

13. The insulating part of claim 1, which is formed in one piece.

14. The insulating part of claim 1, which comprises an injection-molded part.

15. The insulating part of claim 1, which contains a thermoplastic.

16. The insulating part of claim 1, wherein the divider has no hollow spaces.

17. A toroidal core inductive device comprising:

a toroidal core; and an insulating part comprising:

a separating device for separating winding spaces on the toroidal core;

wherein the separating device comprises:

a divider; and a spacer on an end of the divider;

wherein the spacer comprises a spreading part, the spreading part being spreadable widthwise relative to the divider, wherein a width of the divider is less than a width of the spacer when the spreading part is spread, and wherein the divider comprises a first end and a second end that is away from the spreading part, the divider at least reaching a center point of the insulating part that is between the first end and the second end.

18. The toroidal core inductive device of claim 17, wherein sections of the toroidal core on different sides of the divider are wrapped with a winding.

19. The toroidal core inductive device of claim 17, wherein the divider projects past the toroidal core in an axial direction.

20. The toroidal core inductive device of claim 19, wherein the divider projects past the toroidal core by at least 3 mm.

21. The toroidal core of claim 17, wherein the divider has no hollow spaces.

* * * * *

UNITED STATES PATENT AND TRADEMARK OFFICE

CERTIFICATE OF CORRECTION

PATENT NO. : 7,990,248 B2
APPLICATION NO. : 11/816041
DATED : August 2, 2011
INVENTOR(S) : Gunther Feist, Karl Niklas and Jurgen Stabenow It is certified that error appears in the above-identified patent and that said Letters Patent is hereby corrected as shown below:

Title Page, item (54) and col. 1, lines 1-2;
Delete "INSULATION ALEMENT AND TOROIDAL CORE THROTTLE"
and Insert -- INSULATING PART AND TOROIDAL CORE CHOKE --

Signed and Sealed this
Thirty-first Day of January, 2012

David J. Kappos

David J. Kappos
*Director of the United States Patent and Trademark Office*